US005268529A

United States Patent [19]

Kim

[11] Patent Number: 5,268,529

[45] Date of Patent: Dec. 7, 1993

[54] METHOD FOR GENERATING AN ENVELOPE SIGNAL FOR AN ELECTRONIC MUSICAL INSTRUMENT

[75] Inventor: Byoung-Jin Kim, Seoul, Rep. of Korea

[73] Assignee: Goldstar Co., Ltd., Rep. of Korea

[21] Appl. No.: 634,009

[22] Filed: Dec. 26, 1990

[30] Foreign Application Priority Data

Dec. 28, 1989 [KR] Rep. of Korea ..... 19908/1990

[51] Int. Cl.[5] ..... G10H 7/00; G10H 1/02

[52] U.S. Cl. ..... 84/627; 84/621; 84/663

[58] Field of Search ..... 84/621, 626, 627, 662, 84/663

[56] References Cited

U.S. PATENT DOCUMENTS

| | | | |
|---|---|---|---|
| 4,212,221 | 7/1980 | Woron | 84/627 |
| 4,524,668 | 6/1985 | Tomisawa et al. | 84/627 |
| 4,528,885 | 7/1985 | Chihana | 84/626 |
| 4,537,110 | 8/1985 | Sakurai et al. | 84/627 |
| 4,612,838 | 9/1986 | Nagashima et al. . | |
| 4,616,546 | 10/1986 | Uchiyama et al. | 84/659 |
| 4,726,276 | 2/1988 | Katoh et al. | 84/663 |
| 4,781,096 | 11/1988 | Suzuki et al. | 84/606 |
| 4,840,099 | 6/1989 | Kitagawa | 84/627 |
| 4,928,569 | 5/1990 | Kudo et al. | 84/626 |
| 5,074,185 | 12/1991 | Nishikawa et al. | 84/627 |
| 5,109,746 | 5/1992 | Takauji et al. | 84/607 |
| 5,127,304 | 7/1992 | Suzuki et al. | 84/627 |

*Primary Examiner*—William M. Shoop, Jr.
*Assistant Examiner*—Jeffrey W. Donels
*Attorney, Agent, or Firm*—Anthony J. Casella; Gerald E. Hespos

[57] ABSTRACT

The present invention relates to an envelope signal generator for electronic musical instruments, and more particularly to an envelope signal generator that generates natural envelopes from which digital noises are removed substantially by obtaining a difference between a current value and a targeted value and then generating a corresponding value for compensating the difference. The difference value between a pre-stored target value and a current value is obtained through an abs(A − B) generator according to sizes of a current value and a target value, and the difference value is applied to a change value data generator which generates a change value data corresponding with the difference value, an operation is performed according to the sizes of the current value and the target value so as to generate a natural envelope signal from which digital noises are eliminated, and the current value can be directly changed to the target value through an eight-bit multiplexer according to a control signal from a control circuit.

4 Claims, 5 Drawing Sheets

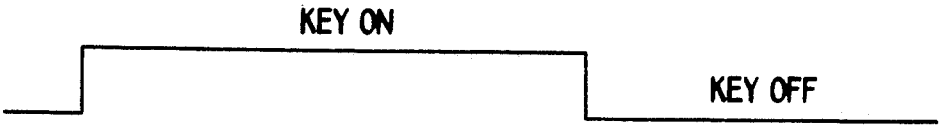
FIG. 2A
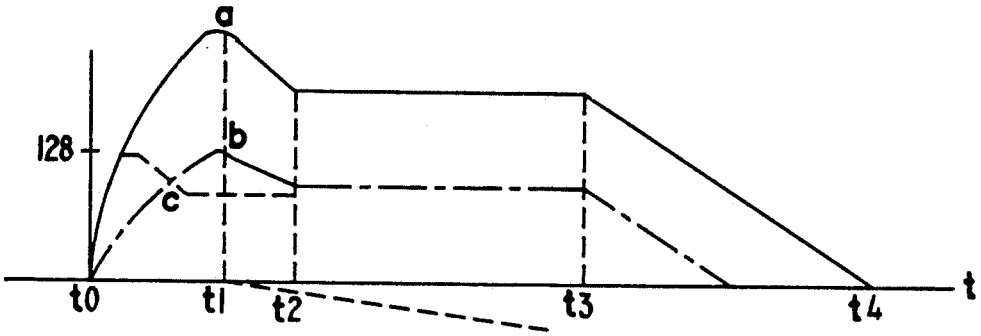
FIG. 2B
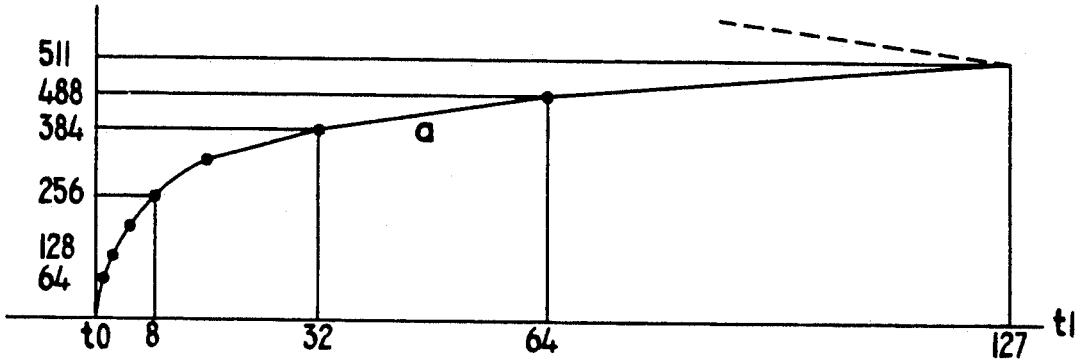
FIG. 2C
| UPPER THREE-BITS VALUE | THE RANGE OF A CURRENT VALUE | A CHANGE VALUE |
|---|---|---|
| 000 | 0~63 | 64 |
| 001 | 64~127 | 64 |
| 010 | 128~191 | 32 |
| 011 | 192~255 | 16 |
| 100 | 256~319 | 8 |
| 101 | 320~383 | 4 |
| 110 | 384~447 | 2 |
| 111 | 448~551 | 1 |
FIG. 2D

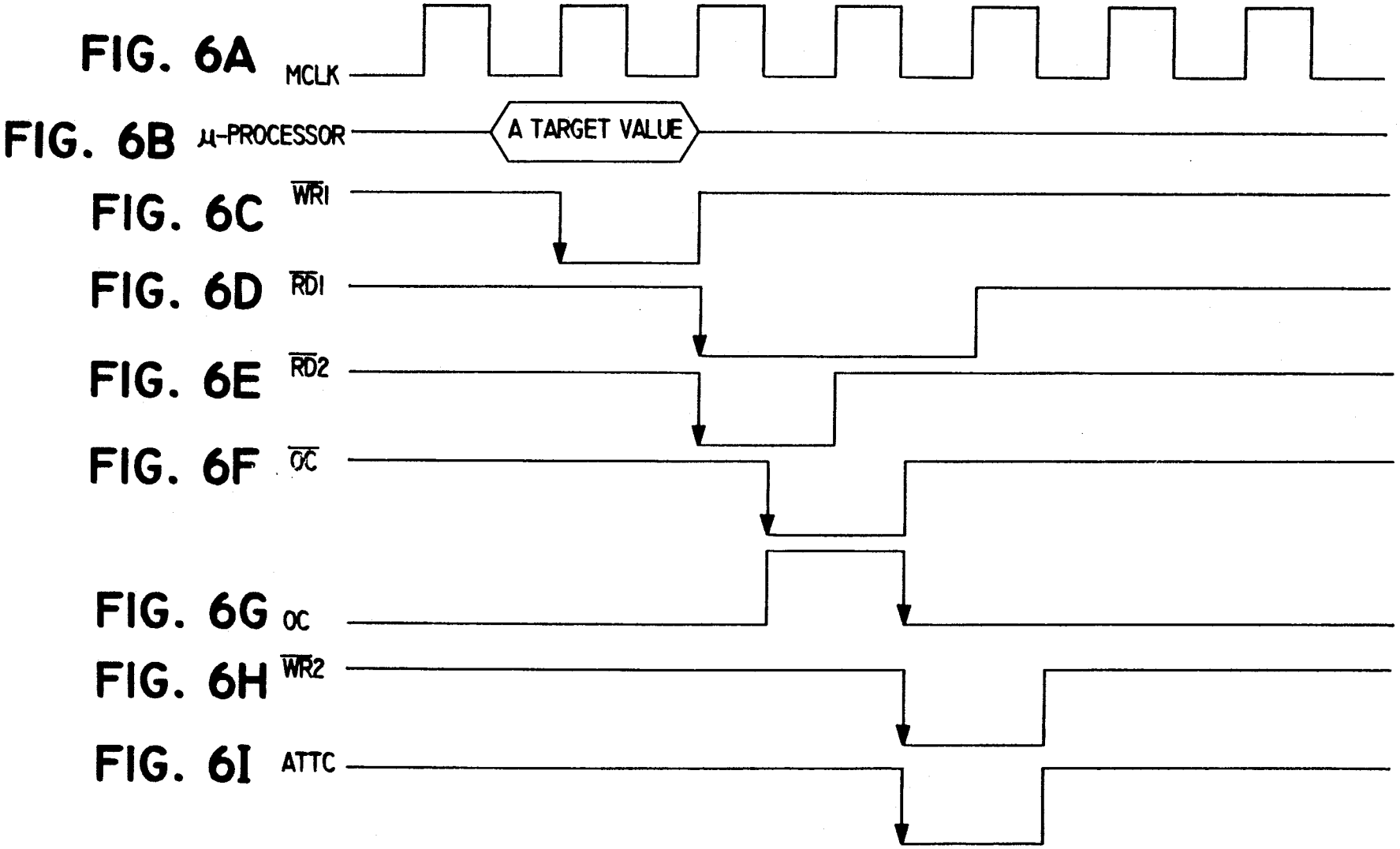
FIG. 6A MCLK
FIG. 6B μ-PROCESSOR
A TARGET VALUE
FIG. 6C $\overline{WR1}$
FIG. 6D $\overline{RD1}$
FIG. 6E $\overline{RD2}$
FIG. 6F $\overline{\alpha C}$
FIG. 6G αC
FIG. 6H $\overline{WR2}$
FIG. 6I ATTC

METHOD FOR GENERATING AN ENVELOPE SIGNAL FOR AN ELECTRONIC MUSICAL INSTRUMENT

BACKGROUND OF THE INVENTION

The present invention relates to an envelope signal generator for electronic musical instruments, and more particularly to an envelope signal generator that generates natural envelopes from which digital noises are removed substantially by obtaining a difference between a current value and a targeted value and then generating a corresponding value for compensating the difference.

In a conventional musical instrument, envelope signals for generating timbres similar to those generated by non-electronic musical instruments have a waveform such as waveform a illustrated in FIG. 2B. That is, signal value increases sharply in an early period t0–t1 of sound generation, slightly decreases in a period t1–t2, is relatively sustained in a period t2–t3 before a key is released, and drastically reduces in a period t3–t4 after the key is released.

An envelope generator that generates an envelope waveform such as above is illustrated in FIG. 1. In the envelope generator illustrated in FIG. 1, it is possible to generate a natural envelope signal by performing an operation that generates an envelope that sharply increases exponentially in the period t0–t1 of a waveform of FIG. 2B by an operation of a digital operation circuit 1.

The digital operation circuit 1 receives current envelope data through an input terminal B and at the same time a change value data through the input terminal A from a gate circuit 5, and performs addition or subtraction operation according to up or down signal from a control circuit 6. The operated envelope data is inputted to a shift register 2, which maintains current value before a next operation is performed.

Meanwhile, of nine bits of output of the shift register 2, upper three bits are inputted to a change value switching circuit 3, and the three bit are used in checking a range to which a current value belongs to and selecting a change value data. That is, when the upper three bits are all 000 as illustrated in a change value data table of FIG. 2D, it is considered that current value belongs to a range of zero to sixty-three and in response the change value switching circuit 3 sends output to a change value data generator 4 which then shows a value of 64.

Accordingly, the change value data generator 4 outputs values of 64, 64, 32, . . . 1 to the gate circuit 5 in response to values of 000, 001, 010, 011, . . . 111 of the shift register 2, and the gate circuit 5 performs open/close operation according to a timing pulse from the control circuit 6 and sequentially operates change value data of 64, 64, 32, . . . 1 of an operation circuit 1. A result of the operation is illustrated in FIG. 2C. That is, in the conventional envelope generator, waveform of an envelope is produced by performing an operation in which a change value is determined according to a current value.

In the conventional envelope signal generator, a value of the change value data is uniformly determined according to a current value, so in case where an envelope has a waveform that does not reach to a maximum value, such as increasing up to a value of 256, not only a rough increase of values of 64, 64, 32 and 16 is resulted but also it is impossible to produce a normal waveform such as the waveform b illustrated in FIG. 2B, and accordingly a waveform such as a waveform c shown in FIG. 2B is resulted.

That is, the conventional envelope generator has a setback that in case where a current value belongs to a range of a low value level, a value of the change value data becomes substantially higher than a value of the change value data of a case where a current value belongs to a range of a high value level, thereby a refined waveform cannot be produced.

SUMMARY OF THE INVENTION

It is therefore an object of the present invention to provide an envelope signal generator that can produce a refined waveform regardless whether a current value is in a range of high or low value level.

BRIEF DESCRIPTION OF THE ATTACHED DRAWINGS

For a better understanding of the invention and to show how the same may be carried into effect, reference will now be made, by way of example, to the accompanying diagrammatic drawings, in which:

FIG. 2A and 2B show general envelope signal waveform in accordance with on/off of a key;

FIG. 2C shows a diagram of a waveform resulted from operation of change value data according to prior art;

FIG. 2D shows a change value data table employed in prior art;

FIGS. 6A–6I show timing diagrams of control signal generated at the status control circuit according to the present invention.

DETAILED DESCRIPTION OF THE INVENTION

Figure 1:
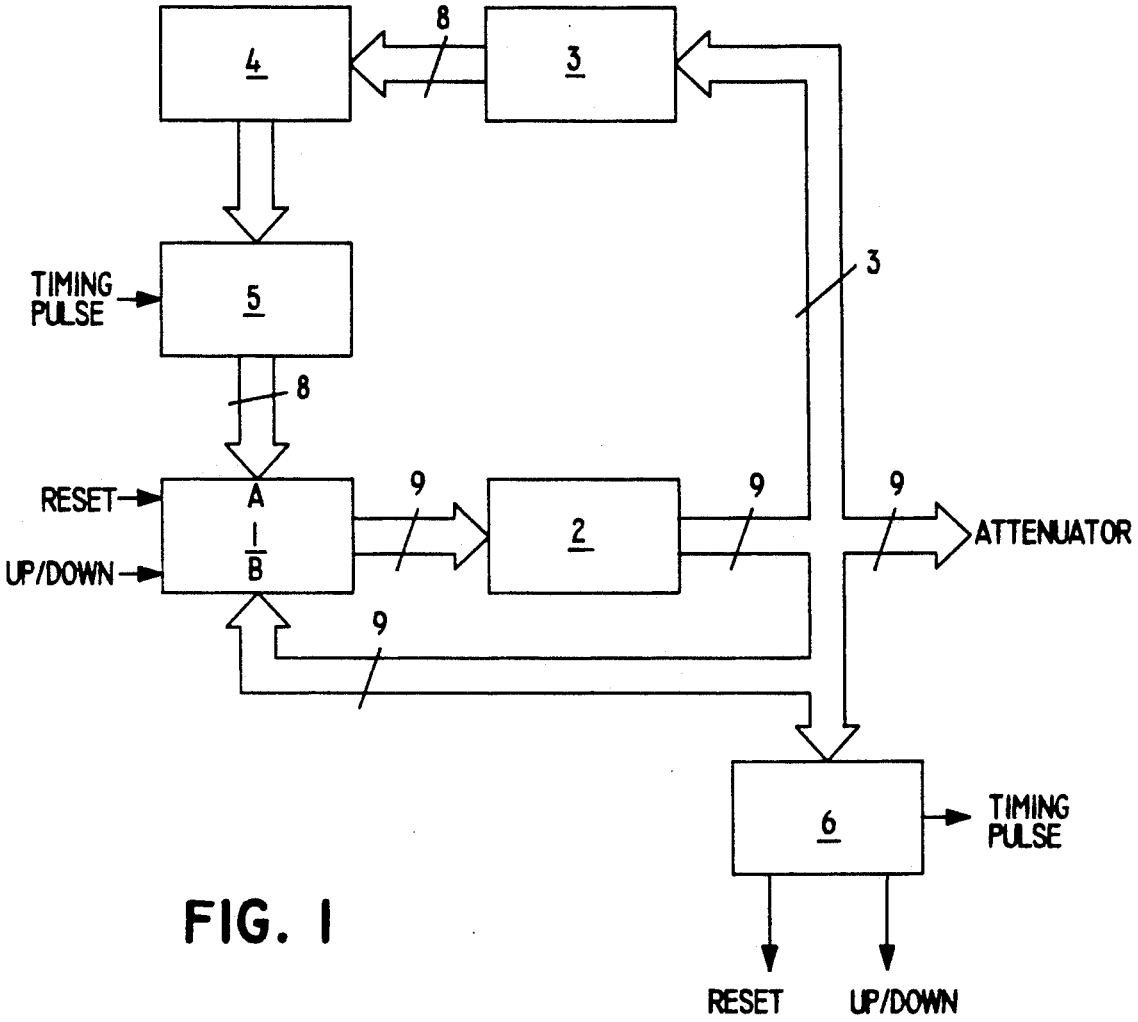
FIG. 1 shows a block diagram of a conventional envelope signal generator.
Figure 3:
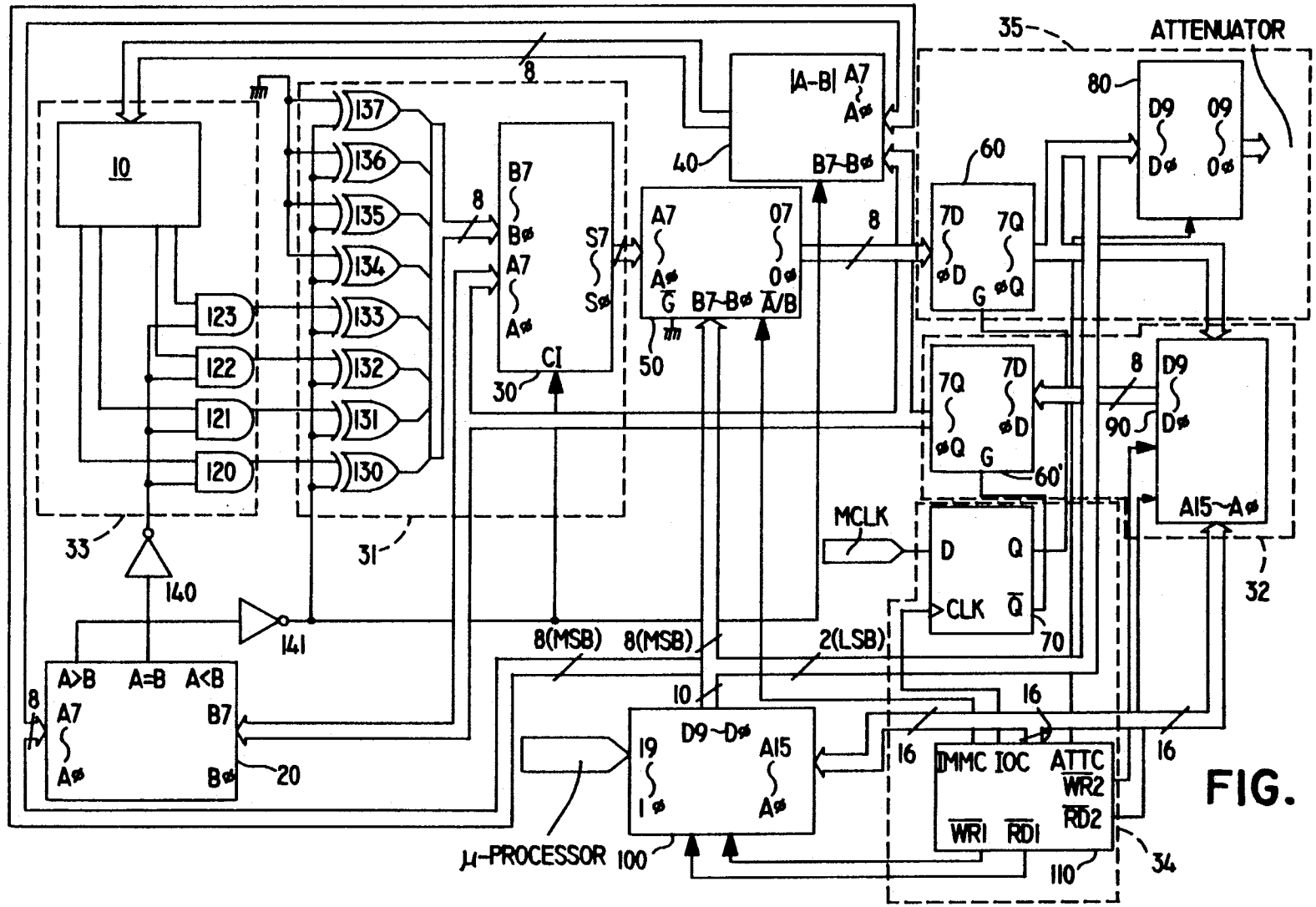
FIG. 3 shows a block diagram of an envelope signal generator according to the present invention.

Referring to FIG. 3, an operation RAM 100, in which target values to be reached are stored, is connected to a micro-processor to receive the target values from the micro-processor, and upper eight-bit of ten-bit target data which are outputted from the operation RAM 100 are connected to an eight-bit comparator 20, to a abs(A − B) generator 40, which enumerates a difference between a current value and a target value, and to an eight-bit multiplexer 50 respectively, and lower two bits are connected to a ten-bit latch 80, and the operation RAM 100 is connected to a status control circuit 110 in order for being addressing.

A status RAM 90, in which transient envelope data is stored while reaching to a target value from a current value, is connected to an eight-bit latch 60 to output data stored therein, and also linked with the status control circuit 110 in order for being addressed, the eight-bit comparator 20 is connected to the operation RAM 100 and the eight-bit latch 60 respectively for determining whether or not a value of an envelope has reached to the target value, and of outputs of the eight-bit comparator 20 an output of A = B is linked with a NOT gate 140 and an output of A>B is linked with a NOT gate 141, an eight-bit binary adder 30 is linked outputs of the eight-bit latch 60 and exclusive OR gates 130–137 respectively to perform addition function, an output fo the eight-bit binary adder 30 is linked with the eight-bit multiplexer 50, and a carry input terminal CI of the eight-bit binary adder 30 is linked with output of the NOT gate 141.

And the eight-bit multiplexer 50 receives an output from the eight-bit binary adder 30 through an input terminal A and an envelope value from the operation RAM 100 through another input terminal B and outputs A or B through output terminal 0 of the eight-bit latch 60 according to a multiplexer control signal IMMC from the status control circuit 110. And the abs(A−B) generator 40 receives an envelope value from the operation RAM 100 through an input terminal A and an envelope value from the eight-bit latch 60 through another input terminal B, enumerates a difference between the two envelope values and outputs the difference value to the change value generator 10. Here, the abs(A−B) generator 40 is linked with an output of the NOT gate 141 as well.

And the change value generator 10 receives signal of the abs(A−B) generator 40 and output terminals of the change value generator 10 are linked with one sides of input terminals of AND gates 123–120, and another sides of the input terminals of the AND gates 123–120 are linked with an output of the NOT gate 140 respectively, and outputs of the AND gates 123–120 are linked with one sides of input terminals of the exclusive OR gates 133–130 respectively, and one sides of the input terminals of the exclusive OR gates 137–134 are linked with ground and another sides of the input terminals of the exclusive OR gates 137–130 are linked with outputs of the NOT gate 141, and outputs of the exclusive OR gates 137–130 are linked with B input terminals of the eight-bit binary adder 30.

And input terminals of the eight-bit latch 60 are linked with the eight-bit multiplexer 50, output terminals of the eight-bit latch 60 are linked with the status RAM, in which a transient value is stored while reaching to a target value from a current value, and also with the upper eight-bit of the ten-bit latch 80, and a G terminal of the eight-bit latch 60 is linked with a Q terminal of a D-flip-flop 70 to synchronize a latching point with a rising point of a reference clock signal.

And input terminals of the eight-bit latch 60 are linked with status RAM 90, output terminals of the eight-bit latch 60 are linked with the abs(A−B) generator 40, the eight-bit binary adder 30 and the eight-bit comparator 20 respectively, and a G terminal of the eight-bit comparator 60 is linked with a Q terminal of the D-flip-flop 70 to synchronize a latching point a falling point of a reference clock signal.

And the D-flip-flop 70 receives a reference clock signal through an input terminal D, an output terminal Q of the D-flip-flop 70 is linked with the eight-bit latch 60, an output terminal Q of the D-flip-flop 70 is linked with an eight-bit latch 60′, and input terminals of a ten-bit latch 80 are linked with outputs of the eight-bit latch 60 and lower two bits of the operating RAM 100.

Figure 4:
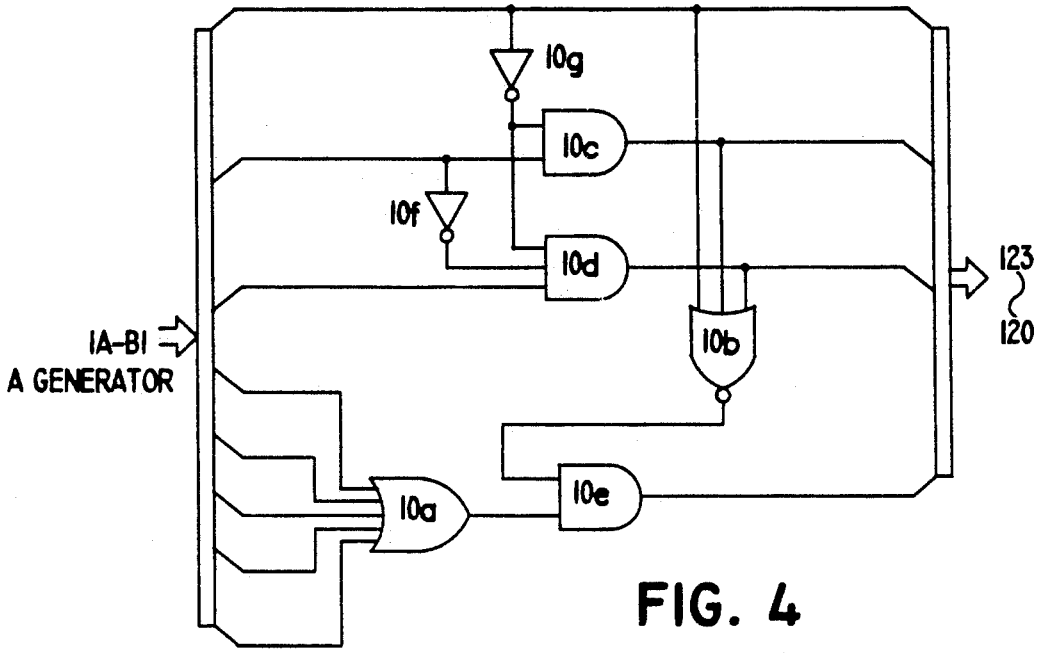
FIG. 4 shows an embodiment of a change value circuit according to the present invention.
Figure 5:
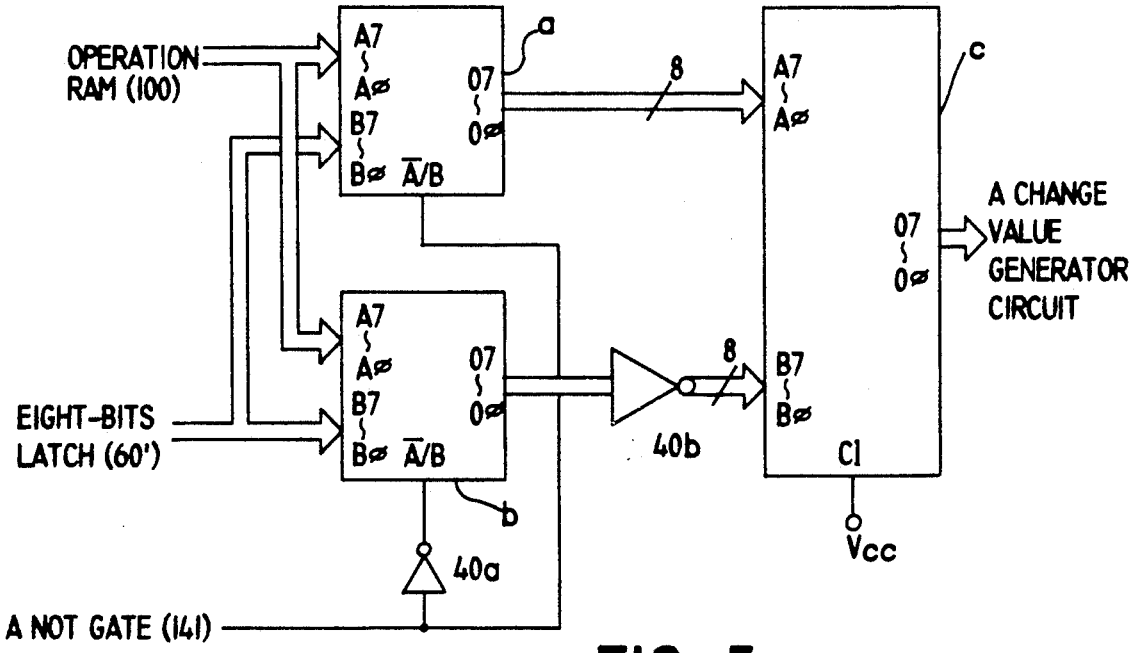
FIG. 5 shows an embodiment of abs(A − B) generator according to the present invention.

Here, the change value generator 10 consists of an OR gate 10*a*, NOT gates 10*f* and 10*g*, AND gates 10*c*–10*e* and a NOR gate 10*b* as illustrated in FIG. 4 so that outputs of the abs(A−B) generator 40 can be received and combined to be applied to as input to AND gates 123–120. And in the abs(A−B) generator 40, as illustrated in FIG. 5 output of the operation RAM 100 is applied to input terminals A(A7–A0) of eight-bit multiplexers a and b, output of the eight-bit latch 60′ is applied to input terminals B(B7–B0) of the eight-bit multiplexers a and b, and output of the NOT gate 141 is linked to input selection terminal A/B of the eight-bit multiplexer a and at the same time linked with input selection terminal A/B of the eight-bit multiplexer b through a NOT gate 40*a*, and output of the eight-bit multiplexer a is applied to input terminal A of an eight-bit binary adder c and output of the multiplexer b is applied to input terminal B of the eight-bit binary adder c through a NOT gate 40*b*, and output of the eight-bit binary adder c is applied to the change value generator 10.

Hereinafter, operational aspect of the inventive envelope signal generator having the foregoing composition.

A target value is inputted from the micro-processor to the operation RAM 100 as illustrated in FIG. 6B, a write signal WR1, whereof one cycle portion of a reference clock MCLK has become 'low', is inputted from the status control circuit 110, so that the target value of FIG. 6B is stored in the operation RAM 100. When a new target value is stored in the operation RAM 100, the status control circuit 110 generates a read signal RD1 as illustrated in FIG. 6D so that the upper eight bits of the target value are sent to the eight-bit comparator 20, the abs(A−B) generator 40 and the eight-bit multiplexer 50, and low-two bits of the target value are sent to the ten-bit latch 80.

At the same time, a read signal RD2, whereof one cycle portion of the reference clock MCLK has become 'low', is generated as shown in FIG. 6E, so that a current value data of the status RAM 90 is outputted to input terminals 7D–0D of the eight-bit latch 60, and in order for latching the signal that is inputted to the eight-bit latch 60′ during a period where the read signal RD2 of FIG. 6E is in 'low' state, a signal as illustrated in FIG. 6F is inputted to the terminal G of the eight-bit latch 60′ from the D-flip-flop 70 so that current value data is inputted to the eight-bit comparator 20, the eight-bit binary adder 30 and the abs(A−B) generator 40, respectively.

Accordingly, when the operation described above is completed, the target value data and the current value data are inputted in corresponding elements, respectively.

The abs(A−B) generator 40 is a circuit for enumerating a difference between the target value data and the current value data and is embodied in FIG. 5. As illustrated in FIG. 5, the abs(A−B) generator consists of the eight-bit multiplexers a and b, the NOT gate 40*a*, the NOT gates 40*b* (40*b*7–40*b*0) and the eight-bit binary adder c, and receives data from the NOT gate 141 of FIG. 3 and controls the terminals A/B of the eight-bit multiplexers a and b in order to input data, which is a bigger one of between the target value and the current value, to terminals A7–A0 of the eight-bit binary adder c.

On the other hand, output of the eight-bit multiplexer b is inputted always through the NOT gates 40*b* (40*b*7–40*b*0) to the terminals B7–B0 of the eight-bit binary adder c in order to produce a complement of value that is inputted to the terminals B7–B0 because a relational expression of A−B=A+B+1 is established. Here, in the relational expression, the value of 1 is to enab generation of abs(A−B) by inputting the logic '1' value to the eight-bit binary adder c. And output of the abs(A−B) generator 40 is inputted to the change value generator 10, which then outputs change values as shown in TABLE 1 below.

TABLE 1

| Ranges of abs(A − B) | Change value |
|---|---|
| 128 < abs(A − B) | 8 |
| 64 < abs(A − B) < 128 | 4 |
| 32 < abs(A − B) < 64 | 2 |
| abs(A − B) < 32 | 1 |

In the TABLE 1, A is a target value to be reached and B is a current value. And the change value can be defined by a value. FIG. 4 is an embodiment of the change value generator for enumerating the change values illustrated above. In the FIG. 4, the change value data outputted from the change value generator are inputted to the AND gates 123–120 respectively and herein it is a role of the AND gate 123–120 to change all data to 0 in order to maintain the current even if the eight-bit binary adder 30 operates when the target value and the current value are the same and this role is controlled by the NOT gate 140.

And the eight-bit comparator 20 is for comparing values between the current value and the target value, and when the target value is greater than the current value, 'high' signal is generated at the output terminal A>B so that the eight-bit binary adder 30 performs addition, and when the current value is greater than the target value, 'low' signal is outputted so that the eight-bit binary adder 30 performs subtraction. And the exclusive OR gates 137–130 and the eight-bit binary adder 30 are for enabling addition and subtraction and are controlled by the NOT gate 141. That is, when the target value is greater than the current value, addition operation is required, thereby the NOT gate 141 outputs 'low' and inputs signal, which is inputted to the exclusive OR gates 137–130, to the eight-bit binary adder 30 without changing the signal, and when the target value is smaller the current value, subtraction operation is required, the signal, which is inputted to the exclusive OR gates is inverted and inputted to the terminal B of the eight-bit binary adder 30. In this case, value of logic '1' is inputted to the carry input terminal CI of the eight-bit binary adder from the NOT gate 141, and in the manner as described above, a result, which is obtained by adding change value data to the current value data or subtracting change value data from the current value data, is inputted to the input terminals A(A7–AO) of the eight-bit multiplexer 50.

Herein, the eight-bit multiplexer 50 is for a use in case where a direct transience from the current value to the target value is desired without going through the transient process as described above. Such direct transience is employed in such musical instruments as percussion instruments having an envelope similar to stairways.

That is, when the target value has reached to other input terminals B(B7–BO) of the eight-bit multiplexer 50 and a direct change from the current value to the target value, it is sufficient to simply add the value of logic '1' to the terminal A/B of the eight-bit multiplexer 50.

However, in general, the terminal A/B of the eighth-bit multiplexer 50 is logic '0' because a smooth transience from the current value to the target value is required.

On the other hand, data value passing through the eight-bit multiplexer 50 is inputted to the eight-bit latch 60, and at a rising point as shown in FIG. 6G operated data is latched at the eight-bit latch F and data value thereof is inputted to the ten-bit latch 80 and the status RAM 90 respectively. And then, in the status control circuit 110, the write signal WR2 as shown in FIG. 6H is outputted and operated data is stored in the status RAM 90 and latched in the ten-bit latch 80 by signal ATTC outputted from the status control circuit 110 as described in FIG. 6I so that an envelope value is outputted.

That is, the operation described above is repeated again and again until value of the status RAM 90 reaches to the operation RAM 100, so that a smooth envelope waveform is produced.

As described in the foregoing, the present invention has advantages that a smooth envelope can be obtained and a current value can be directly changed to a target value regardless of a range the current value belongs to by enumerating a difference between the target value and the current value.

Although specific constructions and procedures of the invention have been illustrated and described herein, it is not intended that the invention be limited to the elements and constructions disclosed. One skilled in the art will easily recognize that the particular elements or subconstructions may be used without departing from the scope and spirit of the invention.

What is claimed is:

1. An envelope signal generator method for eliminating digital noises from electronic musical instruments, comprising the steps of:

inputting target values from a micro-processor to an operation RAM for storing target values to be reached;

storing current values in a current value data storage;

comparing the target value from said operation RAM with the current value from said current value data storage by using an eight-bit comparator;

enumerating a difference between the target value from said operation RAM and the current value from said current value data storage with an abs (A−B) generator;

generating change value data with a change value data generator, said change value data corresponding with the difference value that is applied by said abs (A−B) generator;

inputting to exclusive OR gates each output of the change value data generator, a ground signal and the compared value between the current value and the target value that are applied from the eight-bit comparator;

inputting to an eight-bit binary adder output of said OR gates and the current value data output of the current value data storage and performing addition or subtraction functions according to the compared value between the current value and the target value;

changing the current value directly to the target value with an eight-bit multiplexer which receives the output of said eight bit binary adder and the target value from said operation RAM and selecting input according to a control signal from a control circuit; and latching the output of said eight-bit multiplexer with a latch circuit.

2. An envelope signal generator method for eliminating digital noises from electronic musical instruments, comprising the steps of:

inputting target values from a micro-processor to an operation RAM for storing target values to be reached;

storing current values in a current value data storage;

comparing the target value from said operation RAM with the current value from said current value data storage by using an eight-bit comparator;

enumerating a difference between the target value from said operation RAM and the current value from said current value data storage with an abs (A−B) generator;

generating change value data with a change value data generator, said change value data corresponding with the difference value that is applied by said abs (A−B) generator;

inputting the change value data from said change value data generator to an operations circuit for performing addition and substraction functions according to the compared value applied by said eight-bit comparator;

changing the current value directly to the target value with an eight-bit multiplexer which receives the output of said operation circuit and the target value from said operation RAM and selecting input according to a control signal from a control circuit;

inputting to an eight-bit latch the output of the eight-bit multiplexer and applying to a status RAM a transient envelope data reaching from the current value to the target value; and inputting to a ten-bit latch the output of said eight-bit latch and lower two bits of the operation RAM.

3. An envelope signal generator method for eliminating digital noises from electronic musical instruments, comprising the steps of:

inputting target values from a micro-processor to an operation RAM for storing target values to be reached;

storing current values in a current value data storage;

comparing the target value from said operation RAM with the current value from said current value data storage using an eight-bit comparator;

enumerating the difference between the target value from said operation RAM and the current value from said current value data storage with an abs (A−B) generator by inputting the target value from an eight-bit latch and the current value from the operation RAM to eight-bit multiplexers that selectively output according to output of the eight-bit comparator through a NOT gate, and inputting to an eight-bit binary adder the output of one of said eight-bit multiplexers directly and the output of another one of said eight-bit multiplexers through an inverter and enumerating and outputting a difference value between the target value and the current value;

generating change value data with a change value data generator, said change value data corresponding with the difference value that is applied by said abs (A−B) generator;

inputting the change value data from said change value data generator to an operations circuit for performing addition and subtraction functions according to the compared value applied by said eight-bit comparator;

changing the current value directly to the target value with an eight-bit multiplexer which receives the output of said operation circuit and the target value from said operation RAM and selecting input according to a control signal from a control circuit; and latching the output of said eight-bit multiplexer with a latch circuit.

4. An envelope signal generator method for eliminating digital noise from electronic musical instruments, comprising the steps of:

inputting target values from a micro-processor to an operation RAM for storing target values to be reached;

storing current values in a current value data storage;

comparing the target value from said operation RAM with the current value from said current value data storage by using an eight-bit comparator;

enumerating the difference between the target value from said operation RAM and the current value from said current value data storage with the abs (A−B) generator;

inputting to a change value generation circuit the difference value that is generated by the abs (A−B) generator as a difference between the current value and the target value;

generating change value data with a change value data generator by inputting to an OR gate the output of lower five bits of the difference value of between the target value and the current value applied by said abs (A−B) generator, inputting to inverters and AND gates the upper three bits of the output of said abs (A−B) generator and logicizing the input to the inverters and the AND gates, inputting to a NOR gate output of said AND gates and output of the highest bits, and inputting to an AND gate the output of said OR gate and output of the NOR gate;

inputting the output of said change value data generation circuit to the AND gates, and when the current value and the target value applied from the eight-bit comparator match each other, changing all data to 0 (zero) to maintain the current value regardless of operation of the operation circuit;

inputting the change value data from said change value data generator to an operations circuit for performing addition and subtraction functions according to the compared value applied by said eight-bit comparator;

changing the current value directly to the target value with an eight-bit multiplexer which receives the output of said operation circuit and the target value from said operation RAM and selecting input according to a control signal from a control circuit; and latching the output of said eight-bit multiplexer with a latch circuit.

* * * * *